US007171149B2

(12) United States Patent
Morihara

(10) Patent No.: US 7,171,149 B2
(45) Date of Patent: Jan. 30, 2007

(54) FIXING APPARATUS

(75) Inventor: Kazushige Morihara, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/400,276

(22) Filed: Apr. 10, 2006

(65) Prior Publication Data

US 2006/0193662 A1 Aug. 31, 2006

Related U.S. Application Data

(63) Continuation of application No. 10/804,114, filed on Mar. 19, 2004, now abandoned.

(30) Foreign Application Priority Data

Mar. 25, 2003 (JP) ..... 2003-082917

(51) Int. Cl.
*G03G 15/20* (2006.01)

(52) U.S. Cl. ..... 399/328; 399/330

(58) Field of Classification Search ..... 399/328, 399/330, 333–336

See application file for complete search history.

(56) References Cited

U.S. PATENT DOCUMENTS 4,506,131 A 3/1985 Boehm et al.
5,881,349 A 3/1999 Nanataki et al.
6,316,754 B1 11/2001 Schatz et al.
6,336,027 B1 * 1/2002 Sakai et al. ..... 399/328
6,377,775 B1 4/2002 Nakayama et al.
6,573,485 B2 6/2003 Yokozeki
6,725,000 B2 * 4/2004 Takagi et al. ..... 399/69
6,799,002 B2 9/2004 Birumachi
6,933,479 B2 8/2005 Tanaka et al.
7,006,781 B2 2/2006 Imai et al.
2003/0198481 A1 * 10/2003 Kikuchi et al. ..... 399/69
2005/0207804 A1 9/2005 Kikuchi et al.

FOREIGN PATENT DOCUMENTS

JP 11-015304 A 1/1999

* cited by examiner

*Primary Examiner*—Yaritza Guadalupe-McCall
(74) *Attorney, Agent, or Firm*—Foley & Lardner LLP

(57) ABSTRACT

One of the amount of induction heating by a coil and that of induction heating by coils is increased/decreased relative to the other, and the ratio of the amount of the induction heating by the coil to that of the induction heating by the coils, at which the amount of the induction heating by the coil increases and that of the induction heating by coils decreases, is set at, e.g., "9:1", and the ratio of the amount of the induction heating by the coils to that of the induction heating by the coil, at which the amount of the induction heating by the coils increases and that of the induction heating by coil decreases, is set at, e.g., "7:3".

34 Claims, 4 Drawing Sheets

| | A4R-SIZED PAPER SHEET | A4-SIZED (REGULAR) PAPER SHEET | |
|---|---|---|---|
| FREQUENCY | f1-Δfa | f1-Δfa | f2-Δfb |
| MAIN HEATING COIL | 4a | 4a | 4b, 4c |
| AMOUNT OF INDUCTION HEATING BY MAIN HEATING COIL | P1A (810W) | P1A (810W) | P2B (630W) |
| SUB HEATING COIL | 4b, 4c | 4b, 4c | 4a |
| AMOUNT OF INDUCTION HEATING BY SUB HEATING COIL | P2A (90W) | P2A (90W) | P1B (270W) |
| TOTAL AMOUNT OF HEATING | 900W | 900W | 900W |

FIXING APPARATUS

CROSS-REFERENCE TO RELATED APPLICATIONS

The present application is a continuation of U.S. application Ser. No. 10/804,114, filed Mar. 19, 2004 now abandoned, which in turn claims benefit of priority to Japanese Patent Application No. 2003-082917, filed Mar. 25, 2003, the entire contents of which are incorporated herein by reference.

BACKGROUND OF THE INVENTION

1. Field of the Invention

This invention relates to a fixing apparatus which is provided in an image forming apparatus such as a copying machine or a printer, for fixing a developer-image on a paper sheet.

2. Description of the Related Art

In an image forming apparatus utilizing a digital technique, e.g., an electronic copying machine, when a document table on which an original is placed is exposed, light reflected from the document table is guided to an optical/electrical converting element such as a CCD (charge coupled device).

The CCD outputs an image signal corresponding to an image of the original. A laser beam corresponding to the image signal is radiated onto a photosensitive drum, thereby forming an electrostatic latent image on a circumferential peripheral surface of the photosensitive drum. The electrostatic latent image is visualized by developer. To the photosensitive drum, a paper sheet is fed in accordance with rotation of the photosensitive drum. The above visualized image (developer-image) on the photosensitive drum is transferred onto the paper sheet. Then, the paper sheet is fed to a fixing apparatus.

The fixing apparatus comprises a heat roller and a pressure roller which rotates along with the heat roller while being in pressure-contact with the heat roller. The fixing apparatus holds the paper sheet between the heat and pressure rollers, and fixes the developer onto the paper sheet due to heat of the heat roller, while transferring the paper sheet.

In order for the heat roller to generate heat, there is a method of carrying out induction heating. In the induction heating, a high-frequency current is made to flow through a coil, as a result of which a high-frequency magnetic field is generated from the coil, and an eddy current is generated by the heat roller due to the high-frequency magnetic field. Consequently, the heat roller generates heat by itself due to Joule heat generated by the eddy current.

In a fixing apparatus utilizes such induction heating, a first coil is provided in a position corresponding to a substantially center portion of the heat roller in the axial direction thereof, and second coils are provided in positions corresponding to the both end portions of the heat roller in the axial direction thereof, and the first and second coils are selectively driven.

To be more specific, when a paper sheet having a small size (A4R) is applied, it contacts only the substantially center portion of the heat roller in the axial direction thereof. In this case, only the first coil is driven, since it suffices that only the substantially center portion of the heat roller is heated (since the both end portions are not required to be heated).

When a paper sheet having a regular size (A4) is applied, it contacts the entire area of the heat roller in the axial direction. In this case, both the first and second coils are driven in order that the entire area of the heat roller be heated. However, actually, the first and second coils are alternately driven so that the power consumption falls within a rated power.

When the first and second coils are alternately driven, it is necessary to uniformly maintain the heat of the entire area of the heat roller.

However, in the case where the amount of heat transmitted to the paper sheet is large, or in the case where a heat roller having a small heat capacity, e.g. a heat roller having a thin structure, is adopted in order to shorten the time period required for warming up the fixing apparatus, the temperature of the substantially center portion of the heat roller lowers when driving of the first coil is stopped, and the temperatures of the both end portions of the heat roller lower when driving of the second coil is stopped. Such lowering of the temperature of the substantially center portion or the end portions adversely affects the fixing operation of the fixing apparatus.

BRIEF SUMMARY OF THE INVENTION

The present invention has been made in consideration of the above circumstances, and its object is to provide a fixing apparatus which can avoid lowering of the temperature at its part or parts, and can necessarily properly achieve an fixing operation, and thus has a high reliability.

The fixing apparatus according to the first aspect comprises a heating member including at least a conductor, an induction heating coil comprising first and second coils, a first resonant circuit including the first coil as a structural element, a second resonant circuit including the second coil as a structural element, and a driving circuit for driving the first and second resonant circuits at a plurality of frequencies, wherein the first and second resonant circuits have different resonance frequencies.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

[1] The first embodiment of the present invention will be explained with reference to the drawings.

Figure 1:
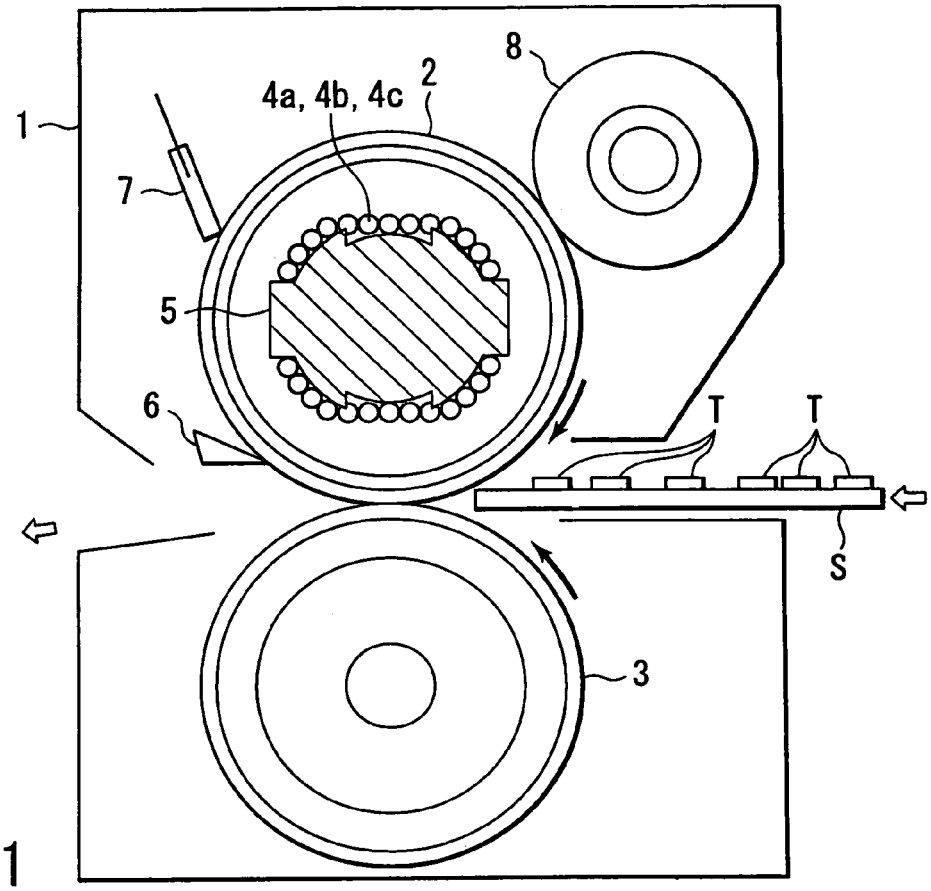
FIG. 1 is a view showing the structure of each of the embodiments of the present invention.

In an image forming apparatus such as a compound electronic copying machine, an original placed on a document table of the apparatus is exposed, and light reflected from the original is guided to an optical/electrical converting element such as a CCD. The CCD outputs an image signal corresponding to an image of the original. A laser beam corresponding to an image signal obtained from the CCD is radiated onto a photosensitive drum, thereby forming an electrostatic latent image on a circumferential peripheral surface of the photosensitive drum. The electrostatic latent image is visualized by developer (toner). The visualized image (developer-image) on the photosensitive drum is transferred onto a paper sheet. The paper sheet is then transferred to a fixing apparatus as shown in FIG. 1.

The operation from reading of the original to feeding of an image is well known, and its detailed explanation will thus be omitted.

A fixing apparatus 1 according to the first embodiment comprises a heat roller 2 and a pressure roller 3 which rotates along with the heat roller 2 while being in pressure-contact with the heat roller 2. The fixing apparatus 1 holds a paper sheet S between the heat roller 2 and the pressure roller 3, and fixes a developer-image T on the paper sheet S due to heat of the heat roller 2, while moving the paper sheet S.

The heat roller 2 is formed of conductive material such as iron. To be more specific, the conductive material is shaped cylindrically, and coated with Teflon or the like, thereby providing the heat roller 2. The heat roller 2 is rotated in a clockwise direction in FIG. 1. On the other hand, the pressure roller 3 is rotated in a counter-clockwise direction in FIG. 1 by rotation of the heat roller 2. The paper sheet S passes through a contact portion between the heat roller 2 and the pressure roller 3, and is heated by heat of the heat roller 2, as a result of which the developer-image T on the paper sheet S is fixed.

In the inner space of the heat roller 2, coils 4*a*, 4*b* and 4*c* for induction heating are provided. The coils 4*a*, 4*b* and 4*c* are wound around a core 5 and held thereby. Also, the coils 4*a*, 4*b* and 4*c* generate a high-frequency magnetic field for induction heating. When the high-frequency magnetic field is generated, an eddy current generates at the heat roller 2, and the heat roller 2 generates heat by itself due to Joule heat by the eddy current.

In a region surrounding the heat roller 2, a stripping claw 6, a cleaning member 7 and a coating roller 8 are provided. The stripping claw 6 strips the paper sheet S from the heat roller 2. The cleaning member 7 removes toner and waste paper or the like, which remain on the heat roller 2, therefrom. The coating roller applies a release agent on a surface of the heat roller 2.

Figure 2:
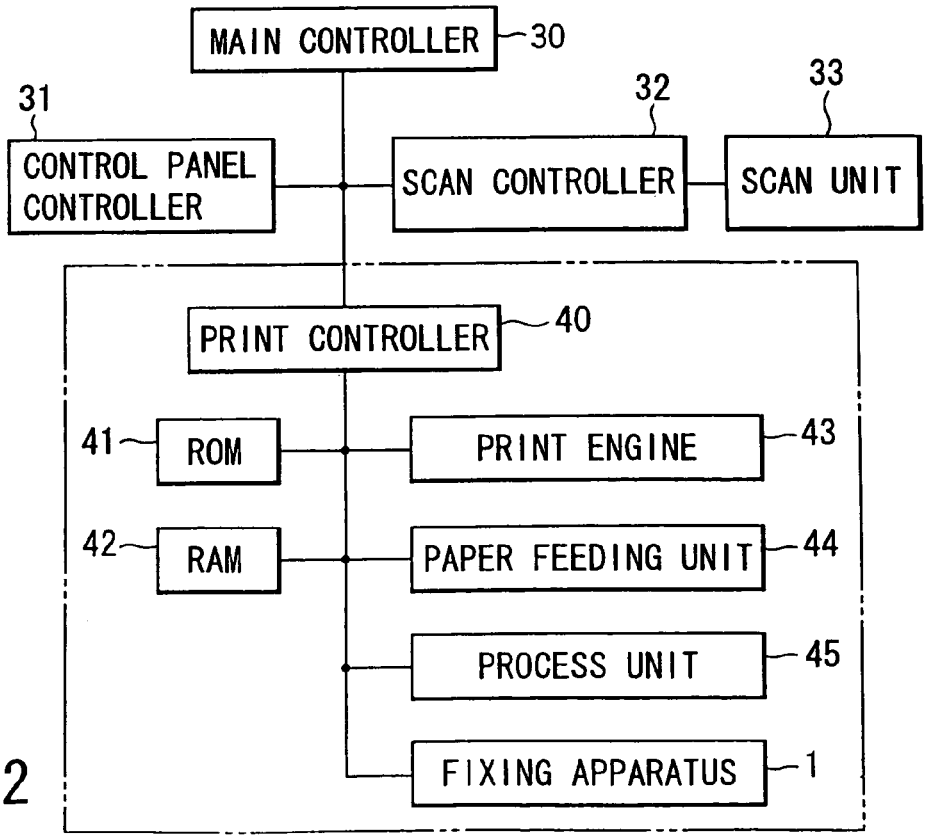
FIG. 2 is a block diagram of a control circuit in an electronic copying machine in each of the embodiments of the present invention.

FIG. 2 shows a control circuit of the image forming apparatus.

In the control circuit, a control panel controller 31, a scan controller 32 and a print controller 40 are connected to a main controller 30. The controller panel controller 31, the scan controller 32 and the print controller 40 are subjected to centralized control by the main controller 30.

To the scan controller 32, a scan unit 33 for reading an original is connected. To the print controller 40, a ROM 41 for storing a control program, a RAM 42 for storing data, a print engine 43, a paper feeding unit 44, a process unit 45 and the above fixing apparatus 1 are connected. The print engine 43 comprises a driving system for driving the above laser beam, etc. The paper feeding unit 44 comprises a feeding mechanism for feeding the paper sheet S and a driving circuit for driving the feeding mechanism, etc. The process unit 45 comprises a photosensitive drum and its peripheral member.

Figure 3:
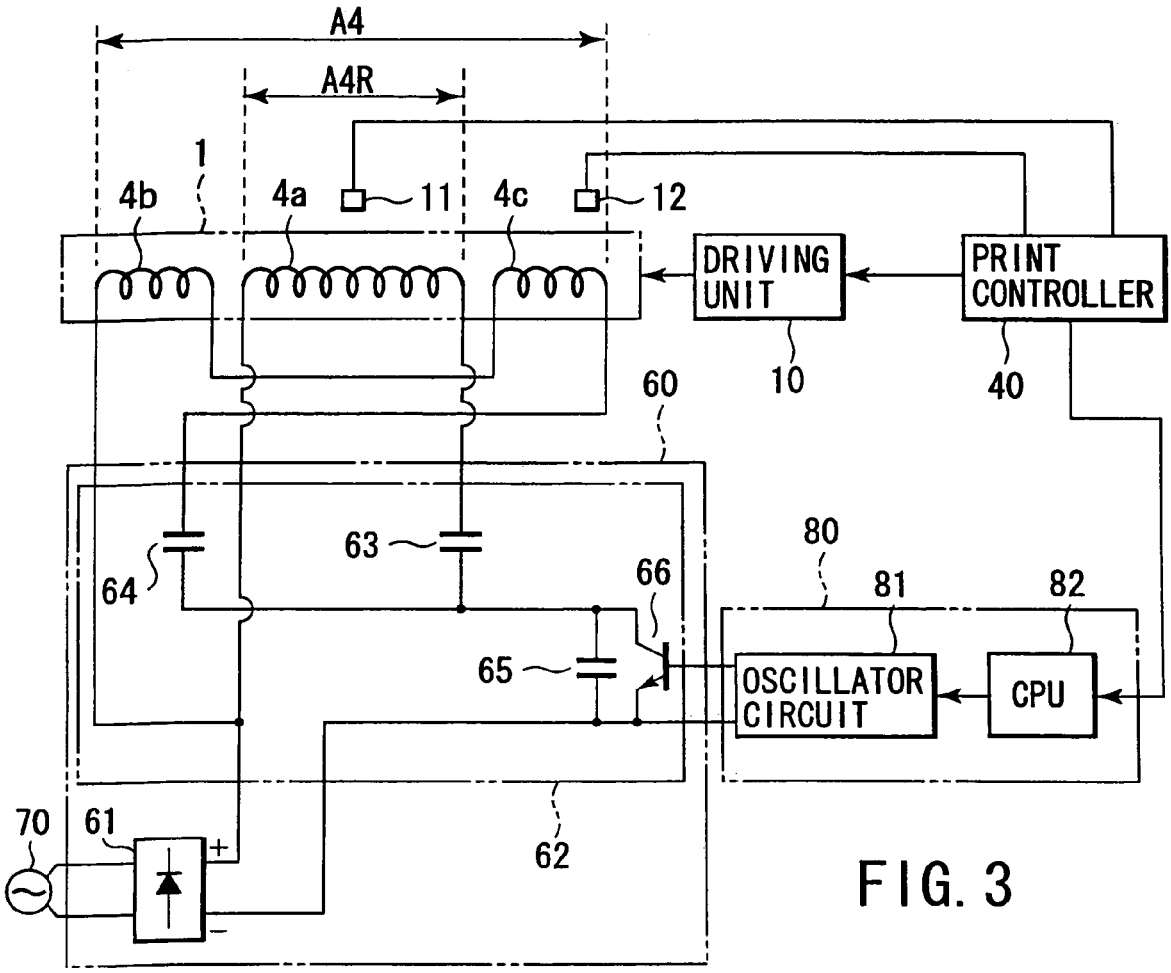
FIG. 3 is a block diagram of an electric circuit in the first and second embodiment of the present invention.

An electric circuit of the fixing apparatus 1 is shown in FIG. 3.

Of the coils 4*a*, 4*b* and 4*c* in the heat roller 2, the coil 4*a* (first coil) is located in a position corresponding to a substantially center portion of the heat roller 2 in the axial direction thereof. The coils 4*a* and 4*c* are connected in series to serve as a single coil (second coil). The coil 4*b* is located in a position corresponding to one end portion (left end portion) of the heat roller 2 in the axial direction of the heat roller 2, and the coil 4*c* is located in a position corresponding to the other end portion (right end portion) of the heat roller 2 in the axial direction thereof.

When a paper sheet S having a small size (A4R) is subjected to fixing, the coil 4*a* is used. When a paper sheet having a regular size (A4) is subjected to fixing, the coils 4*a*, 4*b* and 4*c* are used. The coils 4*a*, 4*b* ad 4*c* are connected to a high-frequency generating circuit 60.

A temperature sensor 11 is provided for the substantially center portion of the heat roller 2 in the axial direction thereof, and a temperature sensor 12 is provided for the other end portion of the heat roller 2. The temperature sensors 11 and 12 are connected along with a driving unit 10 for driving and rotating the heat roller 2, to the print controller 40.

In addition to a function of controlling the driving unit 10, the print controller 40 has a function of controlling driving of a first series resonant circuit and that of a second series resonant circuit, which will both be described later, in accordance with the size of the paper sheet S and the temperatures sensed by the temperature sensors 11 and 12. The first series resonant circuit includes the coil 4*a* as a structural element, and the second series resonant circuit includes the coils 4*b* and 4*c* as structural elements.

The high-frequency generating circuit 60 generates a high-frequency power for generation of a high-frequency magnetic field, and comprises a rectifier circuit 61 and a switching circuit 62 connected to an output terminal of the rectifier circuit 61. The rectifier circuit 61 rectifies the AC voltage of a commercial AC power supply 70. The switching circuit 62 comprises capacitors 63, 64 and 65. The capacitors 63 and 65 and the coil 4*a* constitutes the above first series resonant circuit, and the capacitors 64 and 65 and the coils 4*b* and 4*c* connected in series constitute the above second series resonant circuit. These series resonant circuits are driven by a transistor 66 such as an FET, which serves as a switching element.

The first series resonant circuit has a resonance frequency f1 which is determined by inductance L1 of the coil 4*a*, capacitance C1 of the capacitor 63 and capacitance C3 of the capacitor 65.

The second series resonant circuit has a resonance frequency f2 which is determined by total inductance L2 of the coils 4*b* and 4*c*, capacitance C2 of the capacitor 64 and capacitance C3 of the capacitor 65.

Figure 4:
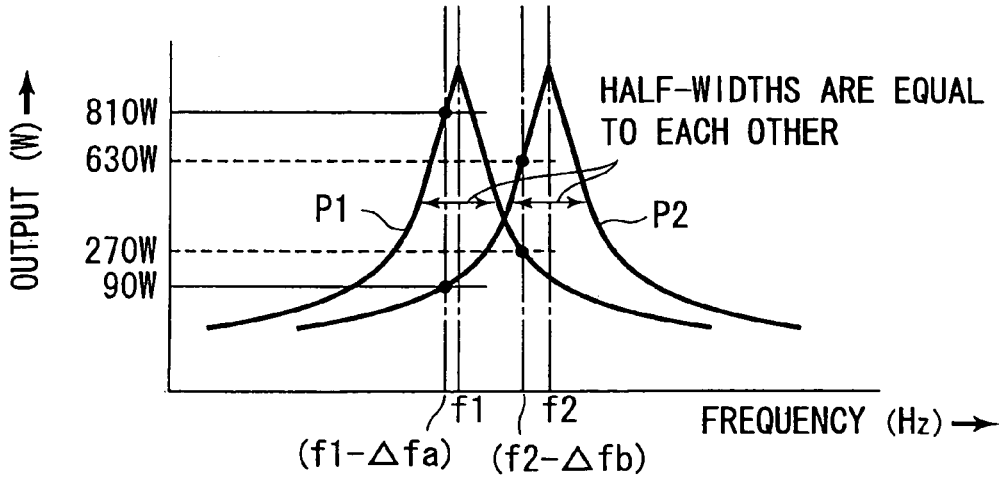
FIG. 4 is a view showing frequency-output characteristics of series resonant circuits in the first embodiment of the present invention.

The first and second series resonant circuits have frequency-output characteristics in which their resonant respective frequencies (f1 and f2) are different, and they have the same half-width, as shown in FIG. 4.

To be more specific, the first resonant circuit has frequency-output characteristics in which the output P1 of the coil 4*a* is maximum when the frequency of a driving signal is equal to the resonance frequency f1, and the output P1 of the coil 4*a* lowers as the frequency of the driving signal increases or decreases with respect to the resonance frequency f1. The difference between the driving signal frequencies at which the output P1 of the coil 4*a* is half its maximum value and which are either side of the resonance frequency f1 is referred to as the half-width of the frequency-output characteristics of the first resonant circuit.

The second resonant circuit has frequency-output characteristics in which the output P2 of the coils 4*b* and 4*c* is maximum when the frequency of the driving signal is equal to the resonant frequency f2, and the output P2 of the coils 4*b* and 4*c* lowers as the frequency of the driving signal increases or decreases with respect to the resonant frequency f2. The difference between the driving signal frequencies at which the output P2 of the coils 4*b* and 4*c* is half its maximum value and which are either side of the resonant frequency f2 is referred to as the half-width of the frequency-output characteristics of the second resonant circuit.

The transistor 66 is turned on/off by a controller 80 in response to a control signal from the print controller 40. The controller 80 comprises an oscillator circuit 81 and a CPU 82, and generates and outputs, from the oscillator circuit 81, a driving signal having a predetermined frequency for the transistor 66.

Furthermore, the print controller 40 and the CPU 82 have, as their main functions, the following means (1) and (2), which are to be respectively applied to the case where fixing is performed on a paper sheet S having a small size (A4R) and the case where fixing is performed on a paper sheet S having a regular size (A4).

(1) means for driving the first series resonant circuit such that induction heating is carried out mainly by the coil 4*a*, i.e., means for making the oscillator circuit 81 output a driving signal having a frequency (f1−Δfa) close to the resonance frequency f1 of the first series resonant circuit, and enabling/disabling the outputting operation of the oscillator circuit 81 so that the temperature sensed by the temperature sensor 11 is constantly kept at a predetermined value; and (2) means, including (i) means, for driving the first series resonant circuit such that induction heating is carried out mainly by the coil 4*a*, and (ii) means for driving the second series resonant circuit such that induction heating is carried out mainly by the coils 4*b* and 4*c*, for effecting switching between the above two means for driving the first and second series resonant circuits, i.e., means for making the oscillator circuit 81 alternately output a driving signal having a frequency (f1−Δfa) close to the resonance frequency f1 of the first series resonant circuit and a driving signal having a frequency (f2−Δfb) close to the resonance frequency f2 of the second series resonant circuit, and enabling/disabling the above output operation by the oscillator circuit 81 so that at least the temperature sensed by the temperature sensor 11 provided for the substantially center portion of the heat roller 2 is constantly kept at a predetermined value.

In the first embodiment, the ratio (induction heating ratio) of the amount of induction heating by the coil 4*a* provided for the substantially center portion of the heat roller 2 to that of induction heating by the coils 4*b* and 4*c* provided for the both end portions of the heat roller 2 is set at 9:1 (810 W:90 W) when mainly the center portion of the heat roller 2 is heated, and it is set at 3:7 (270 W:630 W) when mainly the both end portions of the heat roller 2 are heated.

The above ratios (induction heating ratios) of the amount of induction heating by the coil 4*a* to that of induction heating by the coils 4*b* and 4*c* are not limited to "9:1" and "3:7", respectively. They can be set at arbitrary values.

Next, the operation of the above structure will be explained with references to FIGS. 5 and 6.

In the case where fixing is performed on a paper sheet S having a small size (A4R), a driving signal having a frequency (f1−Δfa) close to the resonance frequency f1 of the first series resonant circuit is output from the oscillator circuit 81. Thereby, a high-frequency magnetic field having an output P1A (=810 W) is generated from the coil 4*a*, and heats mainly the substantially center portion of the heat roller 2 in the axial direction thereof. Also, a high-frequency magnetic field having an output P2A (=90 W) is generated from the coils 4*b* and 4*c*, and heats the both end portions of the heat roller 2 in the axial direction thereof. However, the temperature rise of each of the both end portions is small, since the output P2A (90 W) is small. In such a manner, in the above case, the output of the magnetic field generated from the coils 4*b* and 4*c* is required to be reduced as much as possible, since the paper sheet S having a small size (A4R) does not pass through the both end portions of the heat roller 2. In the present invention, the above requirement is satisfied as described above.

In the case where fixing is performed on a paper sheet having a regular size (A4), a driving signal having a frequency (f1−Δfa) close to the resonance frequency f1 of the first series resonant circuit and a driving signal having a frequency (f2−Δfb) close to the resonance frequency f2 of the second series resonant circuit are alternately output from the oscillator circuit 81.

Figures 5, 6:
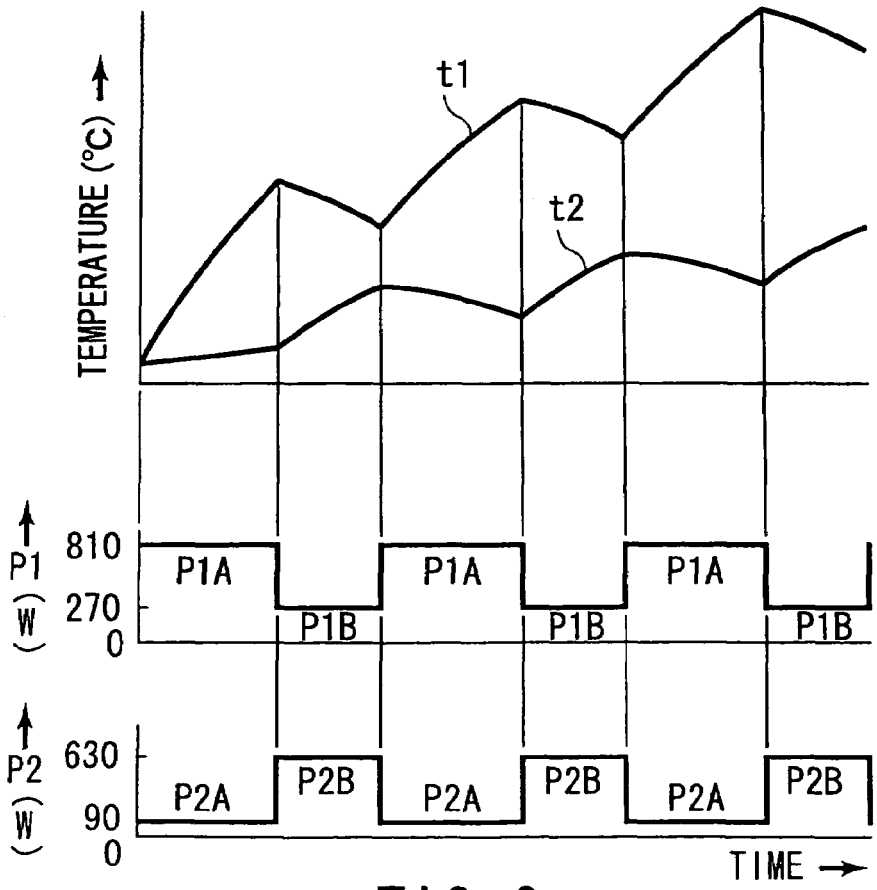
FIG. 5 is a view showing a comparison between induction heating ratio at the time of heating a center portion and an induction heating ratio at the time of heating both end portions in each embodiment of the present invention.
FIG. 6 is a view showing a relationship between the outputs of the series resonant circuits and temperature changes of given portions of a heat roller in each embodiment of the present invention.

To be more specific, first, a high-frequency magnetic field having an output $P1_A$ (810 W) is generated from the coil 4*a* by the driving signal having the frequency (f1−Δfa) as shown in FIG. 6, and heats the substantially center portion of the heat roller 2 in the axial direction thereof as main heating. As a result, the temperature t1 of the substantially center portion of the heat roller 2 increases. At the same time, a high-frequency magnetic field having an output P2A (=90 W) is generated from the coils 4*b* and 4*c*, and heats the both end portions of the heat roller 2 in the axial direction thereof as sub heating. However, the temperature rise of each of the both end portions is small. In this case, the ratio of the output P1A to the output P2A is "9:1".

Subsequently, a high-frequency magnetic field having an output P2B (=630 W) is generated from the coils 4*b* and 4*c* by the driving signal having the frequency (f2−Δfb), and heats the both end portions of the heat roller 2 in the axial direction thereof as main heating. At the same time, a high-frequency magnetic field having an output P1B (=270 W) is generated from the coil 4*a*, and heats the substantially center portion of the heat roller 2 in the axial direction thereof as sub heating. At this time, the ratio of the output P2B to the output P1B is 7:3. In such a manner, the amount of the sub heating is set to satisfy "P2A≦P1B", whereby lowering of the temperature t1 of the substantially center portion is restricted while increasing the temperature t2 of each of the both end portions.

Thereafter, the control of switching the coil for use in the main heating from the coil 4*a* to the coils 4*b* and 4*c* and vice versa is repeated in the above manner.

By virtue of the above features, the temperature of the substantially center portion of the heat roller 2 is prevented from lowering, and also the temperatures of the both end portions of the heat roller 2 is prevented from lowering, unlike the conventional apparatus. In such a manner, the present invention prevents lowering of a part or parts of the heat roller, which would occur in the conventional apparatus. Accordingly, fixing can be properly achieved whenever it is carried out, thus greatly improving the reliability of the fixing.

In the first embodiment, the driving frequencies of the first and second series resonant circuits are set at "(f1−Δfa)" and "(f2−Δfb)", respectively. However, they may be "(f2+Δfb)" and "(f1+Δfa)", respectively.

[2]. The second embodiment of the present invention will be explained.

Figure 7:
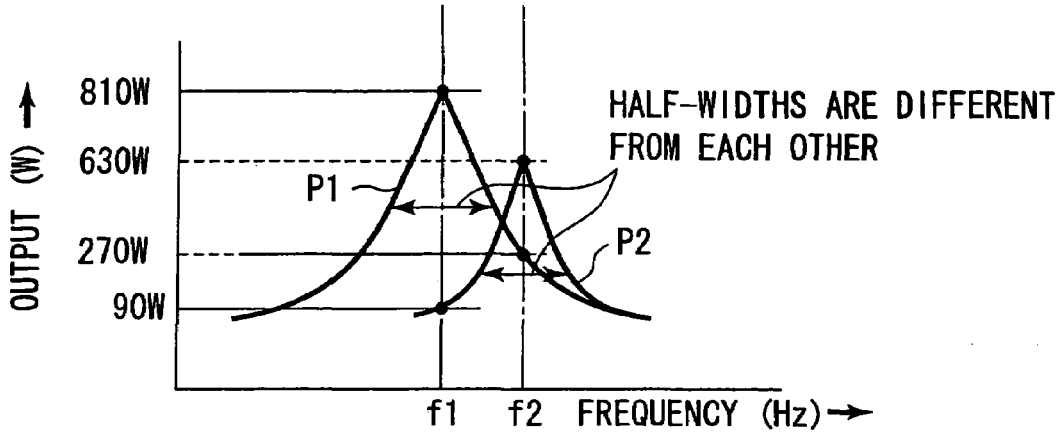
FIG. 7 is a view showing frequency-output characteristics of series resonant circuits in the second embodiment of the present invention.

According to the second embodiment, the first and second series resonant circuits have frequency-output characteristics in which their resonance frequencies f1 and f2 are different and their half-widths are different as shown in FIG. 7.

The print controller 40 and the CPU 82 have, as their main functions, the following means (11) and (12), which are to be respectively applied to the case where fixing is performed on a paper sheet S having a small size and the case where fixing is performed on a paper sheet S having a regular size:

(11) means for driving the first series resonant circuit such that induction heating is carried out mainly by the coil 4*a*, i.e., means for making the oscillator circuit 81 output a driving signal having a frequency equal to the resonance frequency f1 of the first series resonant circuit, and enabling/disabling the outputting operation of the oscillator circuit 81 so that the temperature sensed by the temperature sensor 11 is constantly kept at a predetermined value; and

(12) means, including (i) means for driving the first series resonant circuit such that induction heating is carried out mainly by the coil 4*a*, and (ii) mean for driving the second series resonant circuit such that induction heating is carried out mainly by the coils 4*b* and 4*c*, for effecting switching between the above two means, i.e., means for making the oscillator circuit 81 alternately output a driving signal having a frequency equal to the resonant frequency f1 of the first series resonant circuit and a driving signal having a frequency equal to the resonant frequency f2 of the second series resonant circuit, and enabling/disabling the above output operation by the oscillator circuit 81 so that at least the temperature sensed by the temperature sensor 11 provided for the substantially center portion of the heat roller 2 is constantly kept at a predetermined value.

The operation of the above structure will be explained.

In the case where fixing is performed on a paper sheet S having a small size (A4R), a driving signal having a frequency equal to the resonance frequency f1 of the first resonant circuit is output from the oscillator circuit 81. Thereby, a high-frequency magnetic field having an output P1 (=810 W) is generated from the coil 4*a*, and heats the substantially center portion of the heat roller 2 in the axial direction thereof. Also, a high-frequency magnetic field having an output P2 (=90 W) is generated from the coils 4*b* and 4*c*, and heats the both end portions of the heat roller 2 in the axial direction thereof. However, the temperature rise of each of the both end portions is small.

In the case where fixing is performed on a paper sheet S having a regular size (A4), a driving signal having a frequency equal to the resonant frequency f1 of the first series resonant circuit and a driving signal having a frequency equal to the resonant frequency f2 of the second series resonant circuit are alternately output from the oscillator circuit 81.

The other structure, operation and advantages of the second embodiments are the same as the corresponding structure, operation, advantages of the first embodiment.

[3] The third embodiment of the present invention will be explained.

Figure 8:
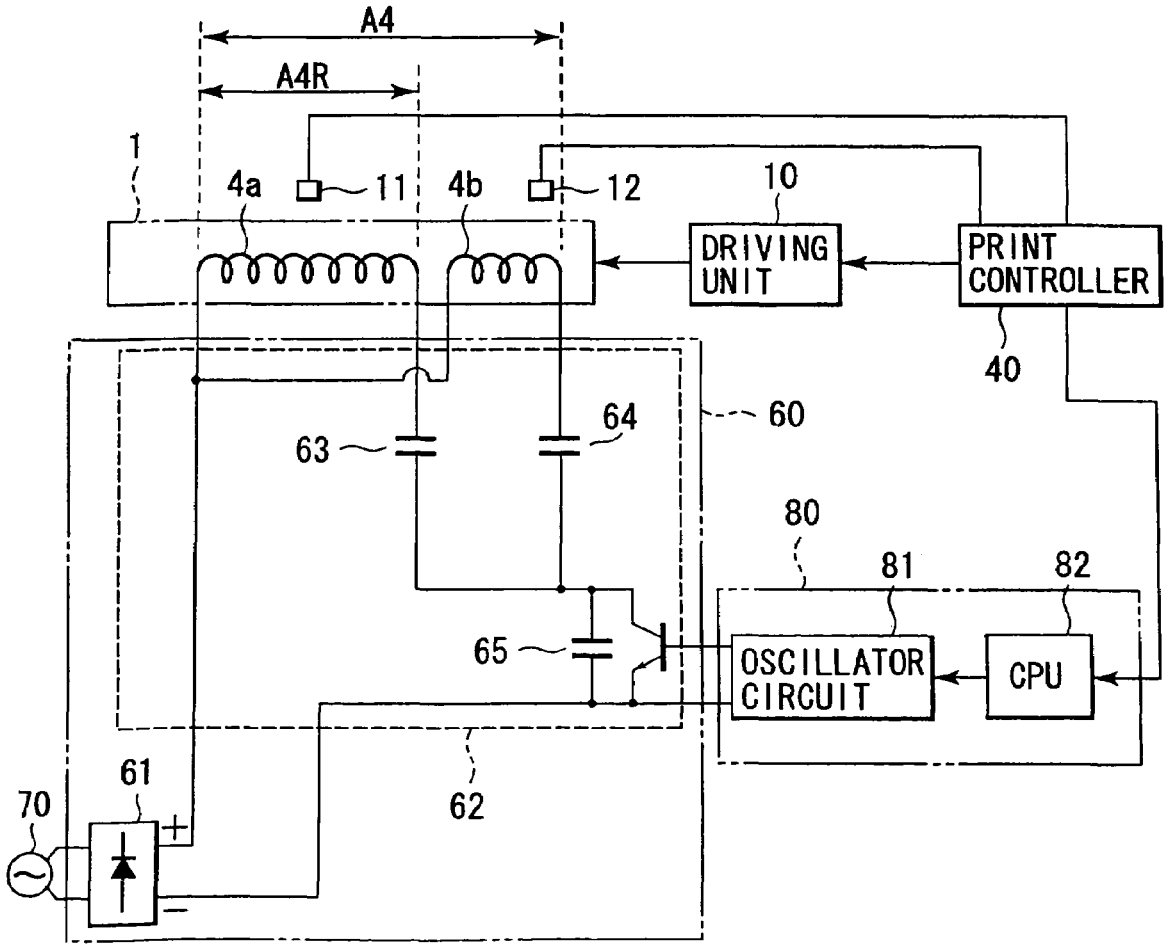
FIG. 8 is a block diagram of an electro circuit in the third embodiment of the present invention.

FIG. 8 shows a circuit diagram of the circuit according to the third embodiment which is a modification of the circuit applied to each of the first and second embodiments.

As shown in FIG. 8, in the third embodiment, the fixing apparatus 1 includes the coils 4*a* and 4*b* only, i.e., it does not include the coil 4*c*, unlike the circuit shown in FIG. 3. The other structural features, operation and advantages are the same as those of the first and second embodiments, and their explanations will thus be omitted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

an heating member including at least a conductor;

a induction heating coil comprising first and second coils;

a first resonant circuit including the first coil as a structural element;

a second resonant circuit including the second coil as a structural element; and a driving circuit which drives the first and second resonant circuits at a plurality of frequencies, wherein the first and second coils are connected in parallel;

wherein the first and second resonant circuits have different resonance frequencies, and the plurality of frequencies include a first and second frequencies which are different, one to the other; and wherein the first frequency is different from the resonance frequency of the first resonant circuit.

2. An apparatus according to claim 1, wherein an output of the first coil is greater than an output of the second coil when the first and second coils are driven at the first frequency, and the output of the second coil is greater than the output of the first coil when the first and second coils are driven at the second frequency.

3. An apparatus according to claim 2, wherein a total of the outputs of the first and second coils remains unchanged even when the first and second frequencies are changed by the driving circuit.

4. An apparatus according to claim 2, which further comprises a controller configured to control the driving circuit, and wherein the controller has at least a mode in which when a paper sheet having a width substantially equal to a width of the first coil in a longitudinal direction of the heating member is fed to the fixing apparatus, the driving circuit performs driving at the first frequency, and a mode in which when a paper sheet having a width greater than the width of the first coil in the longitudinal direction of the heating member is fed to the fixing apparatus, the driving circuit alternately uses the first and second frequencies to alternatively drive the first and second resonant circuits.

5. An apparatus according to claim 2, wherein the first and second resonant circuits are set such that the output of the first coil at time of driving the first coil at the second frequency is greater than the output of the second coil at time of driving the second coil at the first frequency.

6. An apparatus according to claim 2, wherein the outputs of the first and second coils have the following relationship:

$$A:B \neq D:C$$

where A is the output of the first coil at time of driving the first coil at the first frequency, B is the output of the second coil at time of driving the second coil of the second coil at the first frequency, C is the output of the first coil at time of driving the first coil at the second frequency, and D is the output of the second coil at time of driving the second coil at the second frequency.

7. An apparatus according to claim 1, wherein the first and second resonant circuits are formed as a single circuit.

8. An apparatus according to claim 1, wherein the first coil is located in a position corresponding to a substantially center portion of the heating member in the axial direction thereof, and the second coil is located in positions corresponding to both end portions of the heating member in the axial direction thereof.

9. An apparatus according to claim 1, further comprising a pressure member which is rotatable along with the heating member while being in pressure-contact with the heating member.

10. An apparatus according to claim 1, wherein the first and second resonant circuits have frequency-output characteristics in which half-widths of the first and second resonant circuits are equal to each other.

11. An apparatus according to claim 1, wherein the second frequency is different from the resonance frequency of the second resonant circuit by Δf.

12. A fixing apparatus comprising:

a heating member including at least a conductor;

a induction heating coil comprising first and second coils;

a first resonant circuit having a first resonance frequency and including the first coil as a structural element;

a second resonant circuit having a second frequency different from the first frequency and including the second coil as a structural element; and a driving circuit configured to drive the first and second resonant circuits at a plurality of frequencies; and a controller configured to control the driving circuit, wherein the controller has at least a mode wherein when a paper sheet having a width substantially equal to a width of the first coil which is measured in a longitudinal direction of the heating member is fed to the fixing apparatus, the driving circuit drives the first and second resonant circuits at the first frequency, and a mode wherein when a paper sheet having a width greater than the width of the first coil in the longitudinal direction of the heating member is fed to the fixing apparatus, the driving circuits alternately uses the first and second frequencies to alternatively drive the first and second resonant circuits.

13. An apparatus according to claim 12, wherein the first and second resonant circuits are set such that the output of the first coil at time of driving the first coil at the second frequency is greater than the output of the second coil at time of driving the second coil at the first frequency.

14. An apparatus according to claim 12, wherein the first and second resonant circuits have frequency-output characteristics in which half-widths of the first and second resonant circuits are equal to each other.

15. An apparatus according to claim 12, wherein the first frequency is different from a resonance frequency of the first resonant circuit by Δf.

16. An apparatus according to claim 12, wherein the second frequency is different from a resonance frequency of the second resonant circuit by Δf.

17. A fixing apparatus comprising:

a heating member which has at least a conductor;

a first resonant circuit which includes a first coil, and has a first resonance frequency;

a second resonant circuit which includes a second coil, and has a second resonance frequency which is greater than the first resonance frequency;

a driving circuit which drives the first and second resonant circuits at a first frequency and at a second frequency different from the first frequency, wherein the first and second frequency differ from the first and second resonance frequency.

18. An apparatus according to claim 17, wherein the first frequency is Δfa smaller than the first resonance frequency, the second frequency is Δfb smaller than the second resonance frequency, and Δfa is different from Δfb.

19. An apparatus according to claim 18, wherein Δfb is greater than Δfa.

20. An apparatus according to claim 19, wherein a difference between an output of the first coil and an output of the second coil while the driving circuit drives the first and second resonant circuit at a first frequency is greater than a difference between the output of the first coil and the output of the second coil while the driving circuit drives the first and second resonant circuit at the second frequency.

21. An apparatus according to claim 17, wherein the first resonant circuit and the second resonant circuit are connected in parallel.

22. An apparatus according to claim 17, wherein the driving circuit alternatively drives the first and second resonant circuits at the first and second frequencies.

23. An apparatus according to claim 17, wherein the second frequency is included in the range between the first resonance frequency and the second frequency, and the first frequency is not included in the above-mentioned range.

24. An apparatus according to claim 17, wherein the first and second resonant circuits have frequency-output characteristics in which half-widths are different from each other.

25. An apparatus according to claim 17, wherein the driving circuit which alternately outputs a first driving signal having the first frequency and a second signal having the second frequency, and the output time of the first signal and the output time of the second signal are different.

26. A fixing apparatus comprising:

a heating member which has at least a conductor;

first resonant means for including a first coil, and having a first resonance frequency;

second resonant means for including a second coil, and having a second resonance frequency which is greater than the first resonance frequency;

drive means for driving the first and second resonant means at a first frequency and at a second frequency different from the first frequency, wherein the first and second frequency differ from the first and second resonance frequency.

27. An apparatus according to claim 26, wherein the first frequency is Δfa smaller than the first resonance frequency, the second frequency is Δfb smaller than the second resonance frequency, and Δfa is different from Δfb.

28. An apparatus according to claim 27, wherein Δfb is greater than Δfa.

29. An apparatus according to claim 28, wherein a difference between an output of the first coil and an output of the second coil while the drive means drives the first and second resonant means at a first frequency is greater than a difference between the output of the first coil and the output of the second coil while the drive means drives the first and second resonant means at the second frequency.

30. An apparatus according to claim 26, wherein the first resonant means and the second resonant means are connected in parallel.

31. An apparatus according to claim 26, wherein the drive means alternatively drives the first and second resonant means at the first and second frequencies.

32. An apparatus according to claim 26, wherein the second frequency is included in the range between the first resonance frequency and the second frequency, and the first frequency is not included in the above-mentioned range.

33. An apparatus according to claim 26, wherein the first and second resonant means have frequency-output characteristics in which half-widths are different from each other.

34. An apparatus according to claim 26, wherein the drive means for alternately outputting a first driving signal having the first frequency and a second signal having the second frequency, and the output time of the first signal and the output time of the second signal are different.

* * * * *